US008610014B2

(12) United States Patent
Robirds et al.

(10) Patent No.: US 8,610,014 B2
(45) Date of Patent: Dec. 17, 2013

(54) ELECTRICAL SWITCHING APPARATUS, AND STORED ENERGY ASSEMBLY AND ENERGY STORAGE AND RELEASE CONTROL MECHANISM THEREFOR

(75) Inventors: Timothy Gordon Robirds, Sumter, SC (US); Michael Davis Pearce, Plum Branch, SC (US); Michael Lee Herbst, Greenwood, SC (US)

(73) Assignee: Eaton Corporation, Cleveland, OH (US)

( * ) Notice: Subject to any disclaimer, the term of this patent is extended or adjusted under 35 U.S.C. 154(b) by 285 days.

(21) Appl. No.: 13/227,561

(22) Filed: Sep. 8, 2011

(65) Prior Publication Data

US 2013/0062175 A1 Mar. 14, 2013

(51) Int. Cl.
*H01H 5/00* (2006.01)

(52) U.S. Cl.
USPC ..... 200/400

(58) Field of Classification Search
USPC ..... 200/400, 401, 501, 323–325, 337
See application file for complete search history.

(56) References Cited

U.S. PATENT DOCUMENTS 4,596,310 A * 6/1986 Hatakeyama et al. ..... 200/400
5,772,009 A * 6/1998 Rogers et al. ..... 200/400
6,087,610 A * 7/2000 Castonguay et al. ..... 200/400
6,995,327 B1 2/2006 Shepstone et al.
6,998,549 B1 2/2006 Bender et al.
7,186,937 B1 3/2007 Ricciuti et al.
7,449,652 B2 11/2008 Rakus et al.
7,531,761 B2 5/2009 Carson et al.
7,598,468 B2 10/2009 Chen et al.
7,687,733 B2 3/2010 Weister et al.
7,696,447 B2 4/2010 Chen et al.

* cited by examiner

*Primary Examiner* — Felix O Figueroa
(74) *Attorney, Agent, or Firm* — Eckert Seamans Cherin & Mellott, LLC; Grant E. Coffield

(57) ABSTRACT

An energy storage and release control mechanism is provided for a stored energy assembly of an electrical switching apparatus. The stored energy assembly includes a shaft, a stored energy mechanism, and a charging mechanism, such as a charging cam. The charging cam is movable to pivot upon the shaft, thereby charging the stored energy mechanism. The energy storage and release control mechanism includes a ratchet coupled to the charging cam and including a plurality of teeth, a mounting assembly, and a plurality of pawl assemblies. Each pawl assembly includes a pawl pivoting between an engaged position corresponding to the pawl engaging the teeth of the ratchet to resist inappropriate movement of the charging handle, and a disengaged position corresponding to the pawl not engaging the teeth of the ratchet. Preferably, first and second pawl assemblies include first and second pawls, respectively, wherein only one of the first and second pawls engages the teeth of the ratchet at a time.

21 Claims, 6 Drawing Sheets

10−mPCS−561(170)

5/6

10-mPCS-561

ELECTRICAL SWITCHING APPARATUS, AND STORED ENERGY ASSEMBLY AND ENERGY STORAGE AND RELEASE CONTROL MECHANISM THEREFOR

BACKGROUND

1. Field

The disclosed concept relates generally to electrical switching apparatus and, more particularly, to electrical switching apparatus, such as switches. The disclosed concept also relates to stored energy assemblies for switches. The disclosed concept further relates to energy storage and release control mechanisms for stored energy assemblies of electrical switching apparatus.

2. Background Information

Electrical switching apparatus, such as quick make-quick break (QMQB) switches, provide a switching capability and safe short circuit closing capability for electrical systems from electrical fault conditions such as, for example, current overloads, short circuits, abnormal voltage and other fault conditions, and switching electrical loads on and off. Typically, QMQB switches include an operating mechanism which closes or opens electrical contact assemblies to initiate or interrupt the flow of load current through the conductors of an electrical system.

Some medium voltage switches, for example, employ a spring-operated stored energy assembly. Specifically, the operating mechanism of such switches typically includes an operating assembly having one stored energy mechanism (e.g., spring) which facilitates the closing and opening (e.g., separation) of the electrical contact assemblies, and a charging mechanism for charging the spring. The contact assemblies are closed or opened by releasing the stored energy when the charging mechanism has finished charging the operating spring and "toggles" to release the spring's energy of the operating assembly spring. The operating assembly spring is charged either manually, using a manual charging mechanism such as, for example, a charging handle, or automatically using, for example, a motor-driven charging mechanism or other suitable electromechanical charging mechanism.

Inappropriate release of stored energy from the spring can result in damage to the switch operating mechanism. It can also compromise the safety of personnel operating the switch. Prior proposals have employed electrical means for preventing the undesired release of stored energy. However, such designs are susceptible to defeat, for example, by operating personnel error.

There is, therefore, room for improvement in electrical switching apparatus, such as switches, and in stored energy assemblies and energy storage ands therefor.

SUMMARY

These needs and others are met by embodiments of the disclosed concept, which are directed to a energy storage and release control mechanism for a stored energy assembly of an electrical switching apparatus, such as a switch. Among other benefits, the energy storage and release control mechanism resists (e.g., prevents) the undesired release of stored energy.

As one aspect of the disclosed concept, a energy storage and release control mechanism is provided for a stored energy assembly of an electrical switching apparatus. The electrical switching apparatus includes a housing, separable contacts enclosed by the housing, and an operating mechanism structured to open and close the separable contacts. The stored energy assembly comprises a shaft pivotably coupled to the housing, a stored energy mechanism coupled to the shaft, and a charging mechanism structured to charge the stored energy mechanism and apply the stored energy to rotate the shaft. The energy storage and release control mechanism comprises: a charging cam structured to be mounted upon the shaft and being movable to pivot upon but not move the shaft, thereby charging the stored energy mechanism to store energy; a ratchet coupled to the charging cam, the ratchet including a plurality of teeth; a mounting assembly structured to be coupled to the housing; and a plurality of pawl assemblies coupled to the mounting assembly, each of the pawl assemblies comprising a pawl structured to pivot between an engaged position corresponding to the pawl engaging the teeth of the ratchet to restrict rotation of the charging mechanism to one direction at a time, and a disengaged position corresponding to the pawl not engaging the teeth of the ratchet, thus not restricting rotation of the charging mechanism.

The plurality of pawl assemblies may be a first pawl assembly including a first pawl, and a second pawl assembly including a second pawl, wherein only one of the first pawl and the second pawl engages the teeth of the ratchet at a time.

A stored energy assembly and an electrical switching apparatus are also disclosed.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
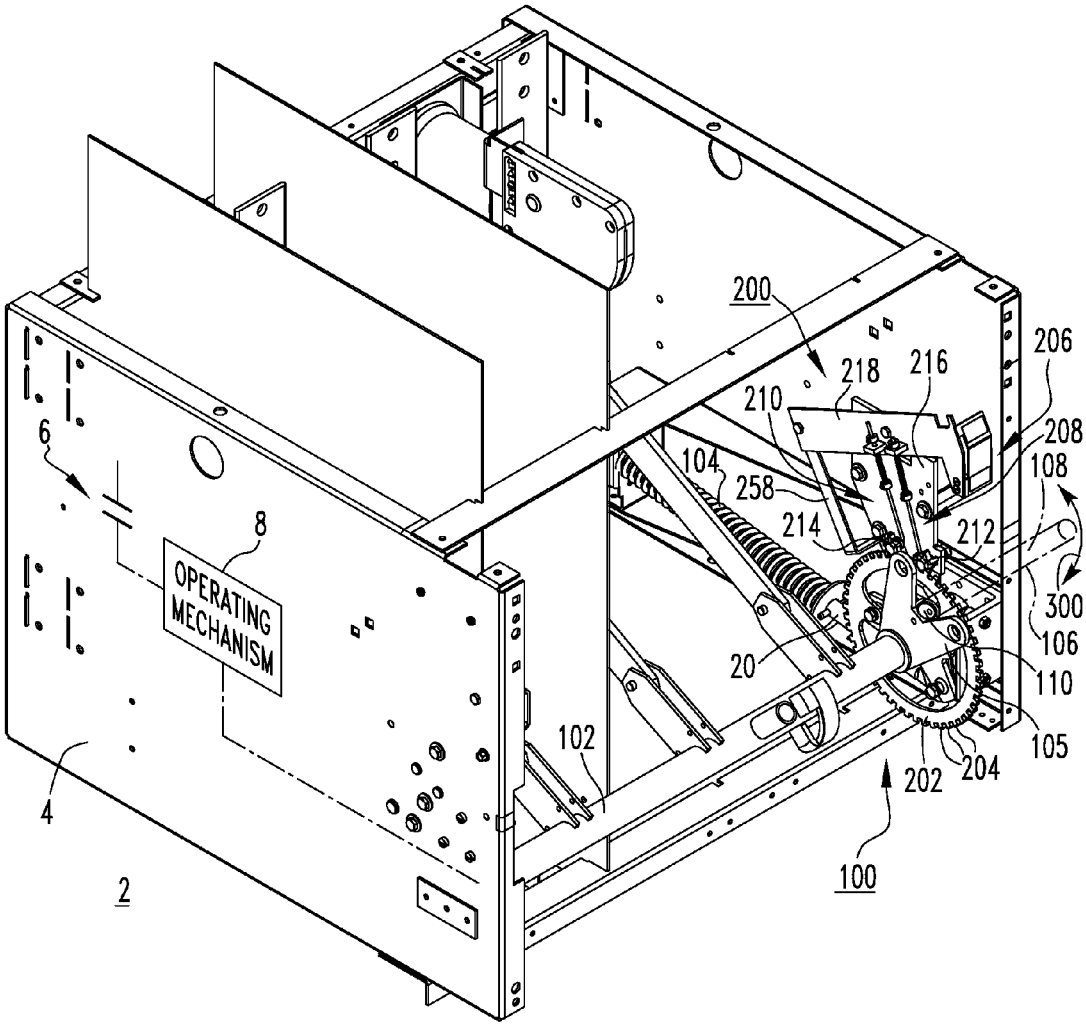
FIG. 1 is an isometric view of a portion of an electrical switching apparatus, and a stored energy assembly and energy storage and release control mechanism therefor, in accordance with an embodiment of the disclosed concept.

For purposes of illustration, embodiments of the invention will be described as applied to medium voltage switches, although it will become apparent that they could also be applied to a wide variety of electrical switching apparatus (e.g., without limitation, circuit switching devices and other circuit interrupters, such as circuit breakers, contactors, motor starters, motor controllers and other load controllers) other than medium voltage switches and other than medium voltage electrical switching apparatus.

Directional phrases used herein, such as, for example, top, bottom, upper, lower, front, back, clockwise, counterclockwise and derivatives thereof, relate to the orientation of the elements shown in the drawings and are not limiting upon the claims unless expressly recited therein.

As employed herein, the term "linking member" refers to any known or suitable mechanism for connecting one component to another and expressly includes, but is not limited to, rigid links (e.g., without limitation, arms; pins; rods), flexible links (e.g., without limitation, wires; chains; ropes), and resilient links (e.g., without limitation, springs).

As employed herein, the term "fastener" refers to any suitable connecting or tightening mechanism expressly including, but not limited to, screws, bolts and the combinations of bolts and nuts (e.g., without limitation, lock nuts) and bolts, washers and nuts, as well as clevis pins, cotter pins, "e ring" fasteners and the like.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 9:
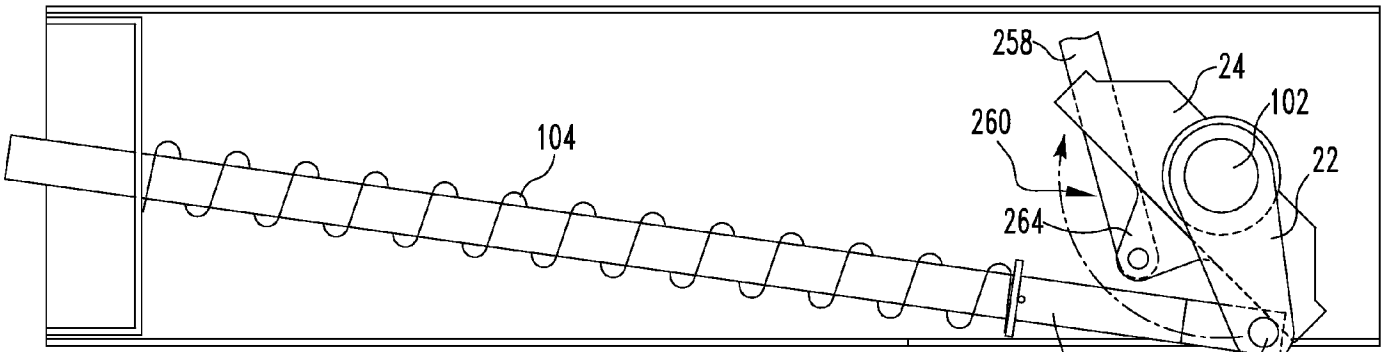
FIG. 9 is a side elevation view of portions of the stored energy and release control mechanism shown in simplified form in the closed position.
Figure 10:
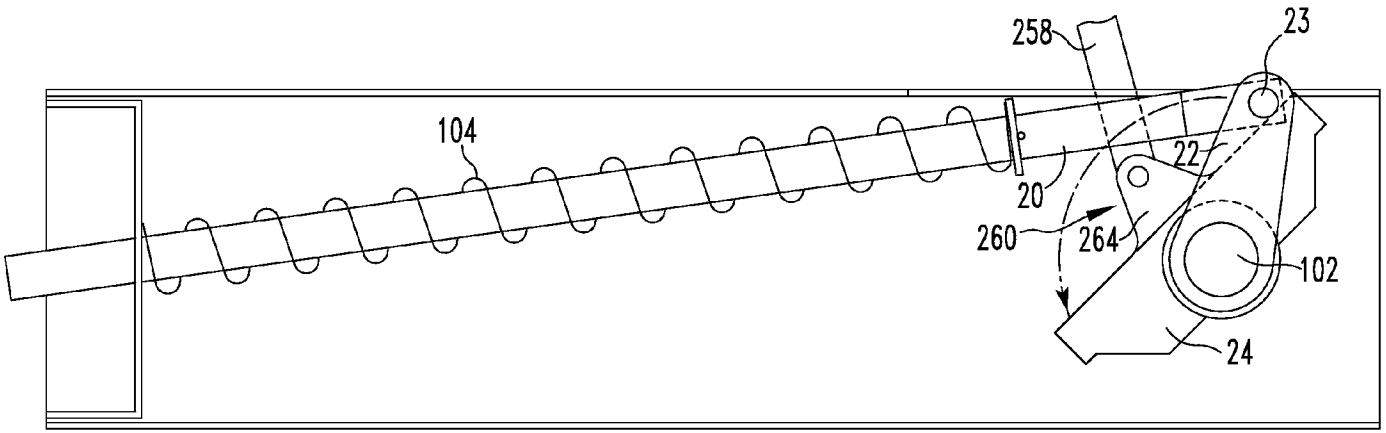
FIG. 10 is a side elevation view of portions of the stored energy and release control mechanism shown in simplified form in the closed position.

FIG. 1 shows a portion of an electrical switching apparatus 2 including a stored energy assembly 100 having an energy storage and release control mechanism 200, in accordance with the embodiment of the disclosed concept. The electrical switching apparatus 2 (e.g., without limitation, the medium voltage switch includes a housing 4, separable contacts 6 (shown in simplified form in FIG. 1) enclosed by the housing 4, and an operating mechanism 8 (shown in simplified form in FIG. 1) structured to open and close the separable contacts 6. The stored energy assembly 100 (also shown in FIGS. 2-6) includes a shaft 102 pivotably coupled to the switch housing 4, a stored energy mechanism such as, for example and without limitation, spring 104, which is coupled to the spring lever 22. More specifically, the spring 104 in the example shown and described herein is attached to a spring rod 20 and spring lever 22 via a spring rod pin 23 (shown in FIGS. 9 and 10 in simplified form), which is fastened in position, for example, with two "e rings" (not shown). The spring lever 22 itself is mounted on, but not pinned to the shaft 102. A charging mechanism includes a charging cam 105 that is mounted on, but not pinned to, the shaft 102, and a handle 106 (see, for example, charging handle 106 shown in phantom line drawing in FIG. 1; partially shown in FIGS. 3-6). In the example of FIG. 1, the charging handle 106 includes an elongated handle member 108, which is structured to be insertable into a receptacle 110 on the spring charging cam 105 extending outwardly from the pivotable shaft 102. The charging handle 106 is movable (e.g., pivotable in the direction of arrow 300 of FIG. 1) to pivot the spring charging cam 105, thereby charging the spring 104 in a generally well known manner. In prior art the spring force would push back on the handle through the full motion of travel as the operating spring was being charged, as there were no devices to resist the spring force from doing so. It will, however, be appreciated that any known or suitable alternative mechanism, such as a suitable electromechanical device (not shown) could be employed instead of, or in addition to, the charging handle 106, without departing from the scope of the disclosed concept.

As will be discussed in greater detail hereinbelow, the energy storage and release control mechanism 200 is structured to resist (e.g., prevent) the undesired release of stored energy of the charged spring 104 until the appropriate time, and in the appropriate manner (e.g., "over toggle"). Accordingly, the disclosed concept is an improvement over known electrical switching apparatus (not shown) that have no such prevention. The energy storage and release control mechanism 200 of the disclosed concept, on the other hand, provides a mechanical solution that addresses and overcomes these and other disadvantages associated with the prior art.

Continuing to refer to FIG. 1, and also to FIGS. 2-6, the energy storage and release control mechanism 200 includes a ratchet 202, which in the example shown and described herein is a toothed wheel member that is coupled to the charging cam 105 of the stored energy assembly 100. It will be appreciated that this can be only a portion of the wheel that is active and for fastening to adjoining part of 105. The ratchet 202 includes a plurality of teeth 204, as shown. A mounting assembly 206 is coupled to the switch housing 4, and a plurality of pawl assemblies 208,210 (two are shown) are coupled to the mounting assembly 206. Each pawl assembly 208,210 includes a pawl 212,214, which is structured to pivot between an engaged position corresponding to the pawl 212, 214 engaging the teeth 204 of the ratchet 202 (see, for example, pawl 214 engaging teeth 204 of ratchet 202 in the enlarged view of FIG. 7), and a disengaged position corresponding to the pawl 212,214 not engaging the teeth 204 of the ratchet 202 (see, for example, pawl 212 disengaged from teeth 204 of the ratchet 202 in FIG. 7). It will be appreciated, therefore, that the energy storage and release control mechanism 200 preferably includes a first pawl assembly 208 having a first pawl 212, and a second pawl assembly 210 having a second pawl 214. In operation, only one of the first pawl 212 and the second pawl 214 engages the teeth 204 of the ratchet 202 at a time (best shown in the enlarged view of FIG. 7).

Figure 2:
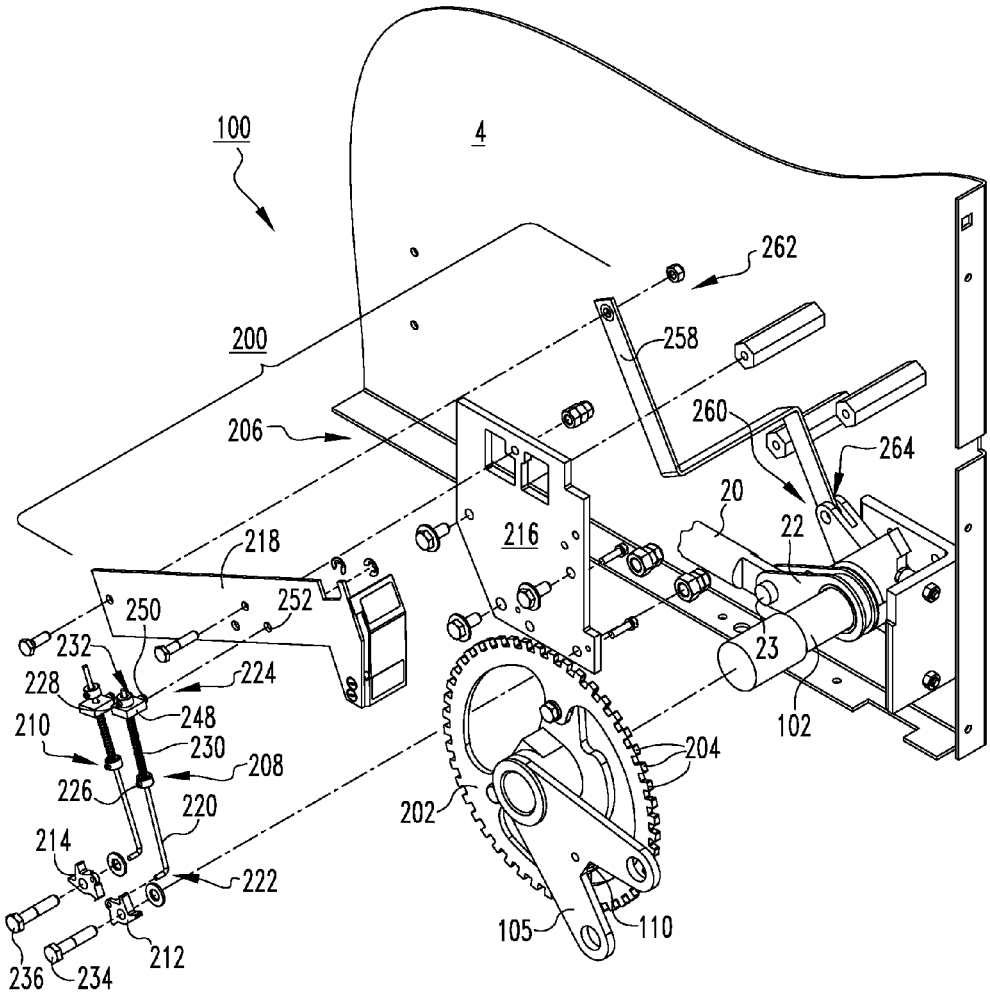
FIG. 2 is an exploded isometric view of the stored energy assembly and energy storage and release control mechanism of FIG. 1.
Figure 8:
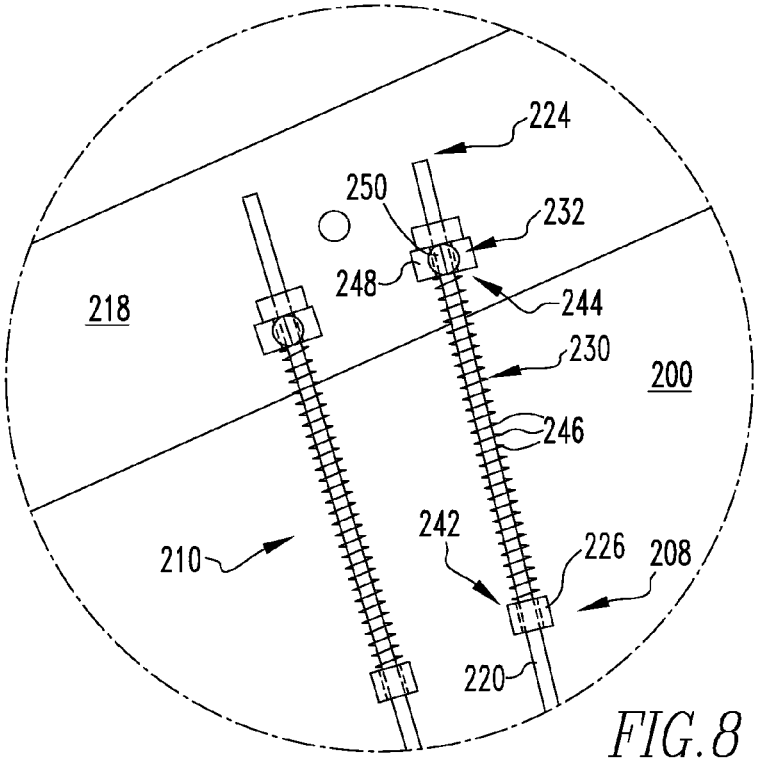
FIG. 8 is an enlarged view of section "FIG. 8" of FIG. 4.

As best shown in the exploded view of FIG. 2, the example mounting assembly 206 includes a mounting bracket 216 and a lever 218 pivotably coupled to the mounting bracket 216. The pawl assemblies 208,210 are coupled to the lever 218. For ease of illustration and economy of disclosure, only one of the pawl assemblies 208 will be described herein, in detail. Specifically, each pawl assembly 208 includes a rod 220, a stopper 226, a biasing spring element 230 disposed on the rod 220 between a corresponding stopper 226 and a pivot connector 232. The pivot connector 232 is pivotably coupled to the lever 218 of the mounting assembly 206. The rod 220 includes first and second opposing ends 222,224. The pawl 212 is pivotably disposed at or about the first end 222, and the pivot connector 232 is disposed proximate the second end 224. More specifically, as best shown in FIG. 8, the exemplary bias element is a spring 230, which is disposed between stopper 226 and pivot connector 232. That is, the spring 230 includes a first end 242, a second end 244 disposed opposite and distal from the first end 242, and a plurality of coils 246. The rod 220 extends through the coils 246. The pivot connector 232 is disposed between the stopper and the second end 244 of the spring 230. The example pivot connector 232 includes a planar portion 248 and a protrusion 250 extending outwardly from the planar portion 248 to pivotably engage a corresponding hole 252 (see, for example, hole 252, best shown in the isometric view of FIG. 2) of the lever 218. Thus, the pawl assembly 208 can pivot with, and with respect to, the lever 218.

Figure 7:
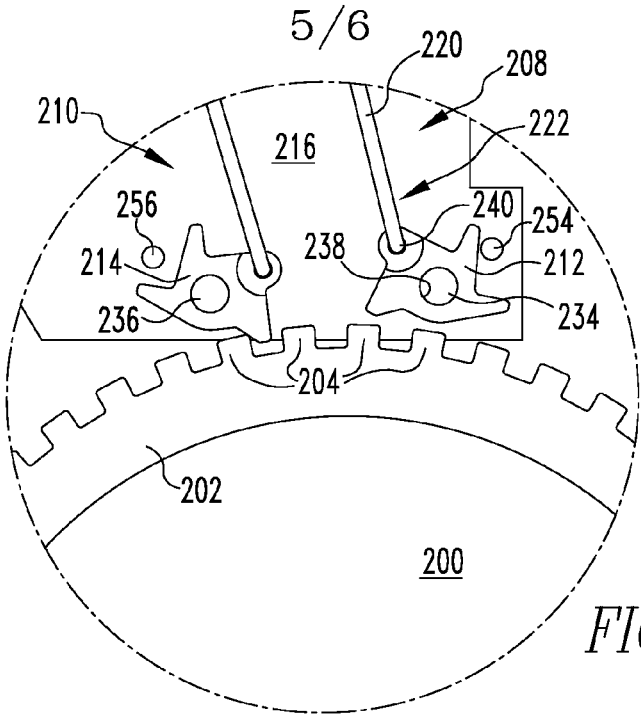
FIG. 7 is an enlarged view of section "FIG. 7" of FIG. 4.

As best shown in FIG. 7, the mounting assembly 206 (FIG. 2) preferably further includes a plurality of pivot members 234,236 (e.g., without limitation, fasteners, such as for example and without limitation, bolts having smooth shank portions). The pawl 212 includes a first aperture 238 and a second aperture 240. The first end 222 of the rod 220 is disposed in the first aperture 240, to pivotably couple the pawl 212 to the rod 220. One of the pivot members 234 extends through the second aperture 238 of the pawl 212, thereby pivotably coupling the pawl 212 to the mounting bracket 216 of the mounting assembly 206.

Figure 3:
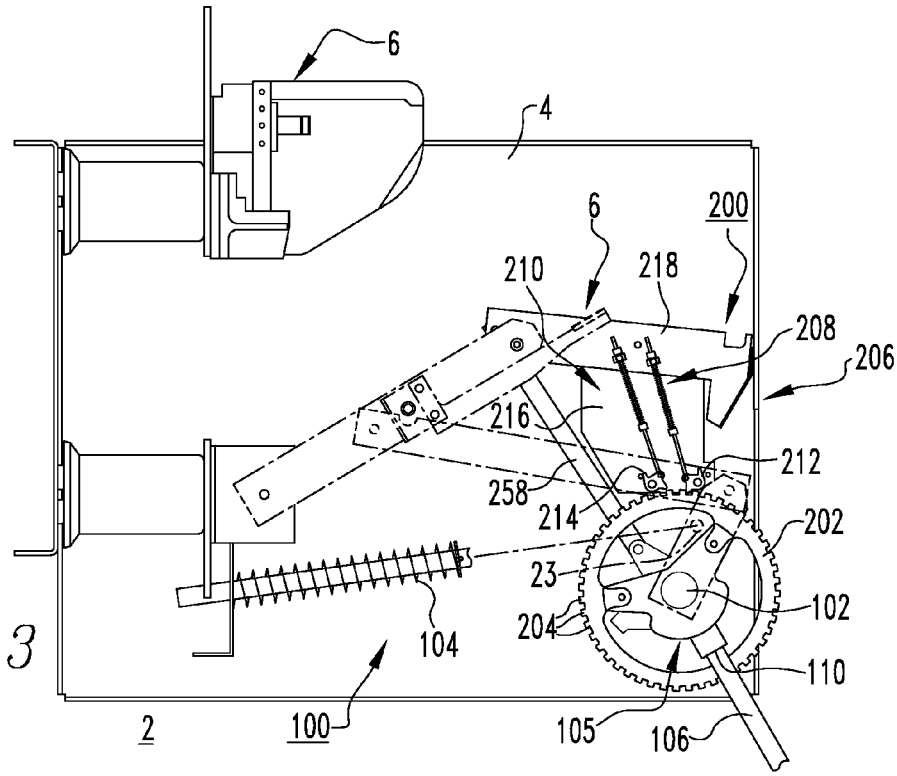
FIG. 3 is a side elevation view of the stored energy assembly and energy storage and release control mechanism, with components being shown in the position corresponding to the electrical switching apparatus being open and the main spring not being charged.
Figure 4:
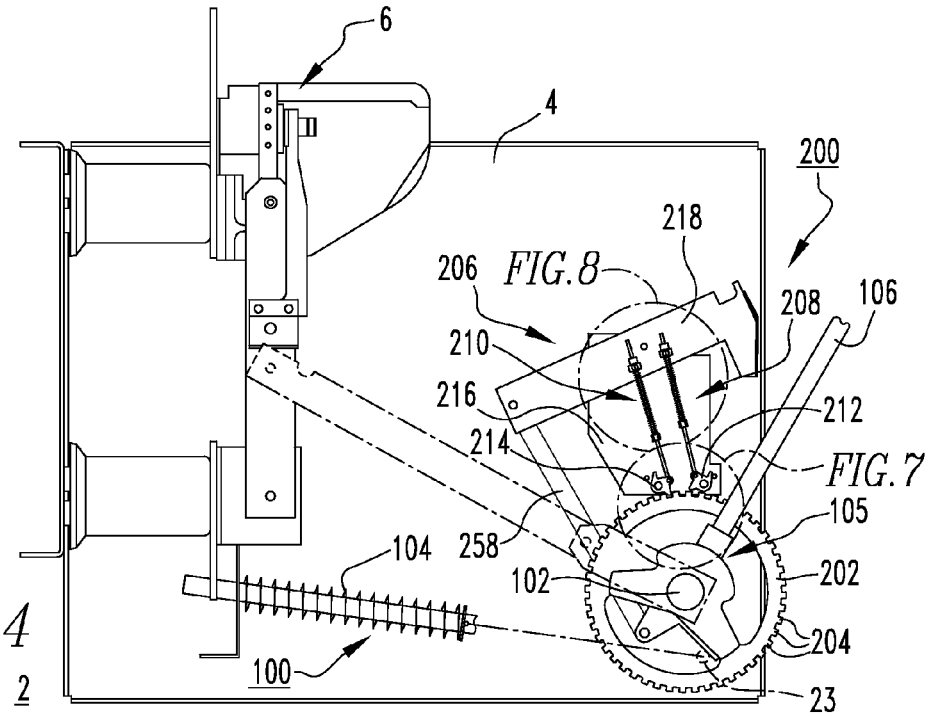
FIG. 4 is a side elevation view of the stored energy assembly and energy storage and release control mechanism, with components being shown in the position corresponding to the electrical switching apparatus being closed and the main spring not being charged.
Figure 5:
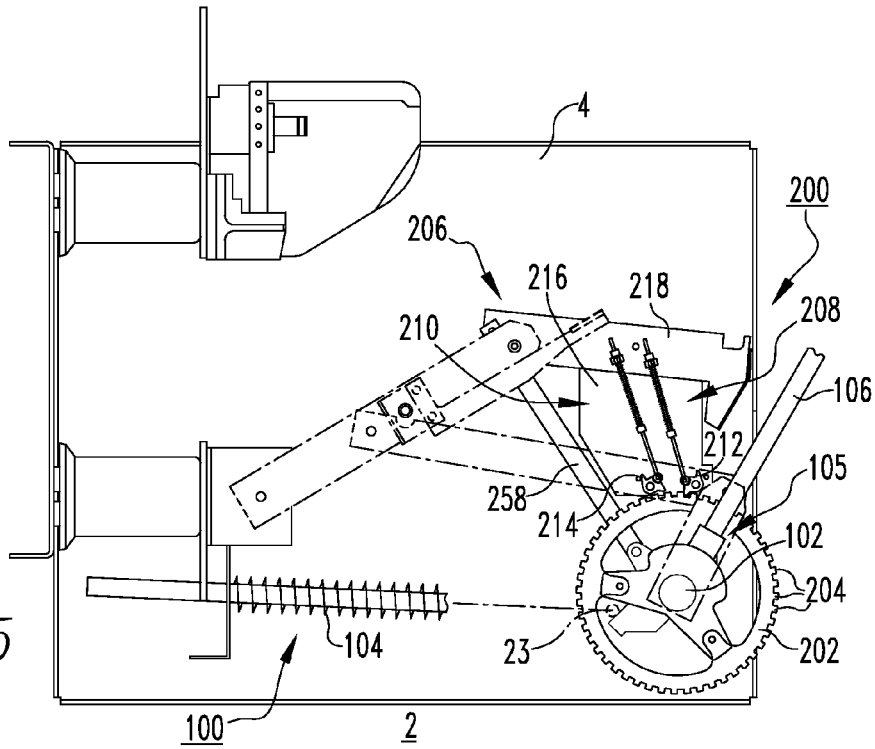
FIG. 5 is a side elevation view of the stored energy assembly and energy storage and release control mechanism, with components being shown in the position corresponding to the electrical switching apparatus being open and the main spring being charged and released to begin closing the switch (e.g., "over toggle")
Figure 6:
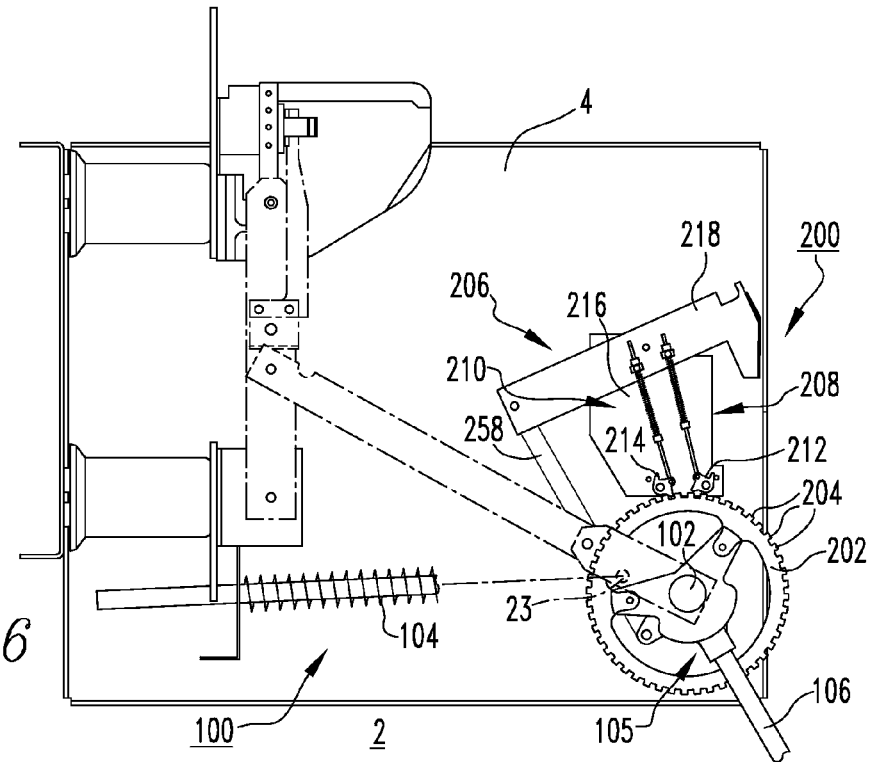
FIG. 6 is a side elevation view of the stored energy assembly and energy storage and release control mechanism, with components being shown in the position corresponding to the electrical switching apparatus being closed and the main spring being charged and released to begin opening the switch (e.g., "over toggle")

As previously discussed, it will be appreciated that in operation only one of the first pawl 212 and second pawl 214 engages the teeth 204 of the ratchet 202 at a time. Specifically, operation of the stored energy assembly 100 and the energy storage and release control mechanism 200 therefor will be further appreciated with reference to FIGS. 3-6. That is, the lever 218 is movable between a first position (FIGS. 3 and 5) corresponding to the separable contacts 6 (FIG. 1) of electrical switching apparatus 2 (FIG. 1) being open, and a second position (FIGS. 4 and 6) corresponding to separable contacts 6 (FIG. 1) being closed. When the lever 218 is disposed in the first position (FIGS. 3 and 5), the first pawl 212 engages the teeth 204 of the ratchet 202 whereas, when the lever 218 is disposed in the second position (FIGS. 4 and 6), the second pawl 214 engages the teeth 204 of the ratchet 202. Therefore, it will be appreciated that the energy storage and release control mechanism 200 provides a mechanical solution for effectively and efficiently engaging (e.g., without limitation, locking) the ratchet 202 and, therefore, the spring lever 22 and charging handle 106, to prevent the undesired or unintended release of stored energy in the spring 104 (FIGS. 1 and 3-6) of a stored energy assembly 100. The alternating, one at a time engagement of the pawls 212,214 accomplishes this task based upon the position of the shaft 102 and charging cam 105. For example and without limitation, FIG. 3 shows the shaft 102, charging cam 105, and charging handle 106 and the remainder of the components in the positions corresponding to the spring 104 not being charged and the separable contacts 6 (FIG. 1) being open. FIG. 4 shows the shaft 102, charging cam 105 and the remainder of the components of the switch 2 in their respective positions corresponding to the separable contacts 6 (FIG. 1) being closed and the spring 104 not being charged. FIG. 5 corresponds to the separable contacts 6 (FIG. 1) being open and the spring 104 of the switch 2 being fully charged, and FIG. 6 corresponds to separable contacts 6 (FIG. 1) being closed and the spring 104 being fully charged.

As best shown in FIG. 7, the function of the example pawl assemblies 208,210 and, in particular, the pawls 212,214 respectively thereof, is controlled by stops 254,256, which in the example shown and described herein are projections extending outwardly from the mounting bracket 216 of the mounting assembly 206. The stops 254,256 control the range of motion of the pawls 212,214, respectively, as desired.

Preferably, the mounting assembly 206 further includes a linking member 258 (best shown in FIG. 2). The linking member 258 has a first end 260 and a second end 262. The first end 260 of the linking member 258 is coupled to a corresponding tab 264 extending outwardly form the aforementioned shaft 102 (see, for example, main lever 24 (FIGS. 9 and 10) that is rigidly coupled to 102). The second end 262 of the linking member 258 is coupled to the lever 218. Accordingly, the linking member 258 moves with the shaft 102 and/or lever 218, as desired. A secondary function of lever 218 is to provide direct visual indication of the position of the separable contacts 6, for example and without limitation, using labels "open" and "closed" or appropriate words and/or symbols on the end where an operator would be standing.

Accordingly, the disclosed energy storage and release control mechanism 200 provides a mechanical mechanism for preventing the undesired release of stored energy from the stored energy mechanism 104 (e.g., without limitation, spring 104 of FIGS. 1 and 3-6), and thereby avoids damage which could otherwise occur to components of the electrical switching apparatus 2, or harm that could be caused to personnel tasked with operating the electrical switching apparatus 2.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An energy storage and release control mechanism for a stored energy assembly of an electrical switching apparatus, said electrical switching apparatus including a housing, separable contacts enclosed by the housing, and an operating mechanism structured to open and close said separable contacts, said stored energy assembly comprising a shaft pivotably coupled to the housing, a stored energy mechanism coupled to said shaft, and a charging mechanism structured to charge said stored energy mechanism and apply stored energy to rotate said shaft, said energy storage and release control mechanism comprising:

a charging cam structured to be mounted upon said shaft and being movable to pivot upon but not move said shaft; thereby charging said stored energy mechanism to store energy;

a ratchet coupled to said charging cam, said ratchet including a plurality of teeth;

a mounting assembly structured to be coupled to the housing; and a plurality of pawl assemblies coupled to said mounting assembly, each of said pawl assemblies comprising a pawl structured to pivot between an engaged position corresponding to said pawl engaging the teeth of said ratchet to resisting undesired movement of said charging mechanism, and a disengaged position corresponding to said pawl not engaging the teeth of said ratchet.

2. The energy storage and release control mechanism of claim 1 wherein said plurality of pawl assemblies is a first pawl assembly including a first pawl, and a second pawl assembly including a second pawl; and wherein only one of said first pawl and said second pawl engages the teeth of said ratchet at a time.

3. The energy storage and release control mechanism of claim 1 wherein said mounting assembly comprises a mounting bracket and a lever pivotably coupled to said mounting bracket; and wherein said pawl assemblies are coupled to said lever.

4. The energy storage and release control mechanism of claim 3 wherein each of said pawl assemblies further comprises a rod, a stopper, a biasing element disposed on said rod between a corresponding stopper and a pivot connector pivotably coupled to said lever; wherein said rod includes a first end and a second end disposed opposite and distal from the first end; wherein said pawl is pivotably disposed at or about the first end; and wherein said pivot connector is disposed proximate the second end.

5. The energy storage and release control mechanism of claim 4 wherein said mounting assembly further comprises a plurality of pivot members; wherein said pawl includes a first aperture and a second aperture; wherein the first end of said rod is disposed in the first aperture; and wherein a corresponding one of said pivot members extends through the second aperture and pivotably couples said pawl to said mounting bracket.

6. The energy storage and release control mechanism of claim 4 wherein said bias element is a spring; wherein said spring includes a first end, a second end disposed opposite and distal from the first end of said spring, and a plurality of coils; wherein said rod extends through said coils; and wherein said pivot connector is disposed proximate the second end of said spring.

7. The energy storage and release control mechanism of claim 6 wherein said pivot connector includes a planar portion and a protrusion extending outwardly from said planar portion; wherein said lever includes a plurality of holes; and wherein the protrusion of said pivot connector is pivotably disposed in a corresponding one of said holes.

8. A stored energy assembly for an electrical switching apparatus including a housing, separable contacts, and an operating mechanism structured to open and close said separable contacts, said stored energy assembly comprising:

a shaft structured to be pivotably coupled to the housing;

a stored energy mechanism coupled to said shaft;

a charging mechanism mounted upon said shaft and being movable to pivot upon but not move said shaft, thereby charging said stored energy mechanism to store energy; and an energy storage and release control mechanism structured to control the release of said stored energy, said energy storage and release control mechanism comprising:

a ratchet coupled to said charging mechanism, said ratchet including a plurality of teeth, a mounting assembly structured to be coupled to the housing, and a plurality of pawl assemblies coupled to said mounting assembly, each of said pawl assemblies comprising a pawl being pivotable between an engaged position corresponding to said pawl engaging the teeth of said ratchet to resist movement of said charging mechanism, and a disengaged position corresponding to said pawl not engaging the teeth of said ratchet.

9. The stored energy assembly of claim 8 wherein said mounting assembly comprises a mounting bracket and a lever pivotably coupled to said mounting bracket; wherein each of said pawl assemblies further comprises a rod, a stopper, a biasing element disposed on said rod between said stopper and a pivot connector; wherein said pivot connector is pivotably coupled to said lever; wherein said rod includes a first end and a second end disposed opposite and distal from the first end; wherein said pawl is pivotably disposed at or about the first end; and wherein said pivot connector is disposed proximate the second end.

10. The stored energy assembly of claim 9 wherein said mounting assembly further comprises a plurality of pivot members; wherein said pawl includes a first aperture and a second aperture; wherein the first end of said rod is disposed in the first aperture; and wherein a corresponding one of said pivot members extends through the second aperture and pivotably couples said pawl to said mounting bracket.

11. The stored energy assembly of claim 9 wherein said bias element is a spring; wherein said spring includes a first end, a second end disposed opposite and distal from the first end of said spring, and a plurality of coils; wherein said rod extends through said coils; wherein said pivot connector is disposed at or about the second end of said spring; wherein said pivot connector includes a planar portion and a protrusion extending outwardly from said planar portion; wherein said lever includes a plurality of holes; and wherein the protrusion of said pivot connector is pivotably disposed in a corresponding one of said holes.

12. The stored energy assembly of claim 9 wherein said plurality of pawl assemblies is a first pawl assembly including a first pawl, and a second pawl assembly including a second pawl; and wherein only one of said first pawl and said second pawl engages the teeth of said ratchet at a time.

13. The stored energy assembly of claim 12 wherein said lever is movable between a first position corresponding to said separable contacts of said electrical switching apparatus being open, and a second position corresponding to said separable contacts being closed; wherein when said lever is disposed in said first position, said first pawl engages the teeth of said ratchet; and wherein when said lever is disposed in said second position, said second pawl engages the teeth of said ratchet.

14. The stored energy assembly of claim 9 wherein said mounting assembly further comprises a linking member including a first end and a second end; wherein said shaft includes a number of tabs; wherein the first end of said linking member is coupled to a corresponding one of said tabs; and wherein the second end of said linking member is coupled to said lever.

15. An electrical switching apparatus comprising:

a housing;

separable contacts;

an operating mechanism structured to open and close said separable contacts; and a stored energy assembly comprising:

a shaft pivotably coupled to the housing, a stored energy mechanism coupled to said shaft, a charging mechanism mounted upon said shaft and being movable to pivot upon said shaft, thereby charging said stored energy mechanism to store energy, and an energy storage and release control mechanism for controlling the release of said stored energy, said energy storage and release control mechanism comprising:

a ratchet coupled to said charging mechanism, said ratchet including a plurality of teeth, a mounting assembly structured to be coupled to the housing, and a plurality of pawl assemblies coupled to said mounting assembly, each of said pawl assemblies comprising a pawl being pivotable between an engaged position corresponding to said pawl engaging the teeth of said ratchet to resist movement of said charging mechanism, and a disengaged position corresponding to said pawl not engaging the teeth of said ratchet.

16. The electrical switching apparatus of claim 15 wherein said mounting assembly comprises a mounting bracket and a lever pivotably coupled to said mounting bracket; wherein each of said pawl assemblies further comprises a rod, a number of stoppers, a biasing element disposed on said rod between a corresponding said stopper and a pivot connector;

wherein said pivot connector is pivotably coupled to said lever; wherein said rod includes a first end and a second end disposed opposite and distal from the first end; wherein said pawl is pivotably disposed at or about the first end; and wherein said pivot connector is disposed proximate the second end.

17. The electrical switching apparatus of claim 16 wherein said mounting assembly further comprises a plurality of pivot members; wherein said pawl includes a first aperture and a second aperture; wherein the first end of said rod is disposed in the first aperture; and wherein a corresponding one of said pivot members extends through the second aperture and pivotably couples said pawl to said mounting bracket.

18. The electrical switching apparatus of claim 16 wherein said bias element is a spring; wherein said spring includes a first end, a second end disposed opposite and distal from the first end of said spring, and a plurality of coils; wherein said rod extends through said coils; wherein said pivot connector is disposed at or about the second end of said spring; wherein said pivot connector includes a planar portion and a protrusion extending outwardly from said planar portion; wherein said lever includes a plurality of holes; and wherein the protrusion of said pivot connector is pivotably disposed in a corresponding one of said holes.

19. The electrical switching apparatus of claim 16 wherein said plurality of pawl assemblies is a first pawl assembly including a first pawl, and a second pawl assembly including a second pawl; wherein only one of said first pawl and said second pawl engages the teeth of said ratchet at a time; wherein said lever is movable between a first position corresponding to said separable contacts of said electrical switching apparatus being open, and a second position corresponding to said separable contacts being closed; wherein when said lever is disposed in said first position, said first pawl engages the teeth of said ratchet; and wherein when said lever is disposed in said second position, said second pawl engages the teeth of said ratchet.

20. The electrical switching apparatus of claim 16 wherein said mounting assembly further comprises a linking member including a first end and a second end; wherein said shaft includes a number of tabs; wherein the first end of said linking member is coupled to a corresponding one of said tabs; and wherein the second end of said linking member is coupled to said lever.

21. The electrical switching apparatus of claim 16 wherein said lever includes a number of position indicators; and wherein said position indicators are structured to indicate the position of said separable contacts.

* * * * *